US007214652B1

(12) United States Patent
Jariwala

(10) Patent No.: US 7,214,652 B1
(45) Date of Patent: May 8, 2007

(54) ANIONIC SURFACTANT-CONTAINING HYPOCHLORITE BLEACH COMPOSITION AND METHODS OF MAKING AND USE

(75) Inventor: Chetan P. Jariwala, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 11/323,794

(22) Filed: Dec. 30, 2005

(51) Int. Cl.
*C11D 3/00* (2006.01)
*C11D 3/295* (2006.01)

(52) U.S. Cl. ..... 510/380; 134/2

(58) Field of Classification Search ..... 510/380; 134/2

See application file for complete search history.

(56) References Cited

U.S. PATENT DOCUMENTS

| | | | | |
|---|---|---|---|---|
| 3,360,470 | A * | 12/1967 | Wixon | 510/308 |
| 3,393,153 | A | 7/1968 | Zimmerer | |
| 3,620,821 | A * | 11/1971 | Gordon | 427/407.3 |
| 3,871,822 | A * | 3/1975 | Goodman et al. | 8/187 |
| 3,876,551 | A | 4/1975 | Laufer et al. | |
| 4,166,974 | A | 9/1979 | Vermeers | |
| 4,203,852 | A | 5/1980 | Johnson et al. | |
| 4,390,448 | A | 6/1983 | Boden et al. | |
| 4,790,953 | A | 12/1988 | Mansy | |
| 4,929,383 | A | 5/1990 | Haendler | |
| 4,931,207 | A | 6/1990 | Cramer et al. | |
| 4,952,333 | A | 8/1990 | Cramer | |
| 5,075,029 | A | 12/1991 | Haendler | |
| 5,080,826 | A | 1/1992 | Colborn et al. | |
| 5,104,571 | A | 4/1992 | Cramer | |
| 5,843,191 | A | 12/1998 | Agostini | |
| 5,869,442 | A | 2/1999 | Srinivas et al. | |
| 6,211,131 | B1 | 4/2001 | Kaaret et al. | |
| 6,297,209 | B1 | 10/2001 | Kaaret et al. | |
| 6,565,612 | B2 * | 5/2003 | Payet et al. | 8/116.4 |
| 2002/0031970 | A1 * | 3/2002 | Arredondo et al. | 442/414 |
| 2006/0043328 | A1 * | 3/2006 | Hunt et al. | 252/8.91 |

FOREIGN PATENT DOCUMENTS

| | | |
|---|---|---|
| EP | 0 206 718 | 8/1990 |

OTHER PUBLICATIONS

ASTM publicaiton DS 53, List of Fluorescent Whitening Agents for the Soap and Detergent Industry, printed in West Point, PA, Apr. 1974.

Wikipedia, http://en.wikipedia.org/wiki/Sodium_hypochlorite, pp. 1-3, entitled Sodium Hypochlorite, printed Nov. 22, 2005.

Wikipedia, http://en.wikipedia.org/wiki/Bleaching_agent, pp. 1-2, entitled Bleach, printed Nov. 22, 2005.

U.S. Appl. No. 11/323,773 (3M 61443US002), filed Dec. 30, 2005, entitled Amine Oxide Surfactant-Containing Hypochlorite Bleach Composition and Methods of Making and Use.

* cited by examiner

*Primary Examiner*—Mark Kopec
*Assistant Examiner*—John M Petruncio

(57) ABSTRACT

A liquid composition comprising an aqueous mixture of a softener emulsion and alkali metal hypochlorite wherein said softener emulsion contains an anionic stabilizing surfactant.

12 Claims, No Drawings

ANIONIC SURFACTANT-CONTAINING HYPOCHLORITE BLEACH COMPOSITION AND METHODS OF MAKING AND USE

FIELD

The present invention relates to liquid hypochlorite bleaching compositions, in particular those useful in treating fabrics, and methods of making and using such compositions.

BACKGROUND

Hypochlorite liquid bleaches have found wide commercial acceptance and are commonly used in a variety of household cleaning and laundering products. However, there are certain limitations to the utility of hypochlorite bleaches.

One limitation of hypochlorite bleaches is the aroma which is typically considered distinctive and disagreeable. To address this, it is known to incorporate fragrances in bleach compositions to impart a more desirable aroma thereto. U.S. Patent No. 5,080,826 (Colborn et al.) discloses a stable, fragranced liquid hypochlorite bleach composition. U.S. Pat. Nos. 3,876,551 (Laufer et al.) and 4,390,448 (Borden et al.) disclose stable alkali metal hypochlorite liquid solutions containing perfumes and certain amide oxide or anionic surfactants.

Another well known limitation of hypochlorite bleaches is that in addition to providing desired whitening or bleaching of a garment, treatment with hypochlorite bleaches tends to make garments look worn and undergo pilling after several washings as the bleach composition tends to attack the fibers. In some instances, garments or other fabric articles treated with hypochlorite bleach will even develop holes.

SUMMARY

It has been discovered that hypochlorite bleach compositions containing emulsions of certain softeners and certain stabilizing surfactants as described herein will provide heretofore unattained shelf stability and performance. Compositions of the invention provide effective bleaching performance while imparting reduced wear and degradation and enhanced softness to the treated fabric article.

The present invention relates to new hypochlorite bleach compositions that provide a number of advantages as compared to previously known hypochlorite bleach compositions. Compositions of the invention provide excellent bleaching performance, provide longer shelf life and are more storage stable, and provide more gentle conditioning of fabrics, resulting in less degradation of the fabrics when compositions of the invention are used. The invention provides new bleach compositions, methods for making such compositions, and methods for using such compositions.

In brief summary, compositions of the invention comprise an aqueous mixture of an alkali metal hypochlorite and softener emulsion containing an anionic stabilizing surfactant.

Briefly summarizing, compositions of the invention may be made by providing a softener emulsion containing an anionic stabilizing surfactant and mixing such emulsion with an aqueous alkali metal hypochlorite solution.

In brief summary, compositions of the invention may be used to treat articles, e.g., fabrics and other garments, in conventional manner.

DETAILED DESCRIPTION OF ILLUSTRATIVE EMBODIMENTS

In brief summary, treatment compositions of the invention are aqueous liquid compositions comprising alkali metal hypochlorite and a softener emulsion of certain fabric softener components containing anionic stabilizing surfactant, and optionally, desired adjuvants and additives.

The alkali metal hypochlorite used in the present invention is selected from the group consisting of: sodium hypochlorite, potassium hypochlorite, lithium hypochlorite, and mixtures thereof.

If desired, the pH of the bleach composition may be adjusted, typically preferably to a range of about 10 to about 14. For example, a sufficient quantity of one or more alkali metal hydroxides, e.g., selected from the group consisting of lithium hydroxide, potassium hydroxide, sodium hydroxide, and mixtures thereof may be added to the composition. If the pH of the bleach composition is too low it will tend to lose effectiveness more quickly, i.e., will exhibit a relatively shorter shelf life than would otherwise be the case.

The temperature at which compositions of the invention remain both substantially stable and commercially useful for the purposes set forth herein varies from approximately 20° F. (−7° C.) up to approximately 120° F. (50° C.). At temperatures below about 20° F. the composition will typically separate into a two-phase system and at temperatures higher than about 120° F. the bleaching or sterilizing efficiency of the composition of the invention is diminished at an excessive rate.

Treatment compositions of the invention will typically comprise from about 1 to about 16 weight percent, typically preferably from about 3 to about 5 weight percent, of alkali metal hypochlorite. Compositions comprising lesser amounts of hypochlorite may tend to be less effective than desired. Compositions comprising greater amounts of hypochlorite will typically be more corrosive and potentially more troubling to work with.

Fabric softeners used in the present invention are preferably polyethylene-based. Illustrative examples include oxidized polyethylene, polyethylene acrylic acid, polyethylene/polypropylene, polypropylene, polyethylene, polyethylene/paraffin wax emulsions, and combinations thereof.

In order to make a bleaching composition of the invention, an aqueous emulsion of the softener is prepared. Typically, an aqueous emulsion of the softener is prepared with other surfactant(s), e.g., one or more ionic or non-ionic surfactants, to yield a preliminary emulsion and then augmented by addition of one or more stabilizing surfactants as described herein. This permits selection of emulsifying surfactants based on desired emulsion properties and then selection of a different stabilizing surfactant in accordance with the present invention based on desired performance in the bleach composition.

The emulsions may be prepared via any of various known techniques. The size of the emulsion particles can be controlled by selection of emulsifying conditions, e.g., temperature, pressure, and surfactant level. The particles of softening within the emulsion are typically from about 0.020 to about 0.2 microns in size, preferably from about 0.035 to about 0.07 microns in size.

The aqueous emulsion is then augmented by adding an anionic stabilizing surfactant such as is discussed below before being added to the bleach composition.

Some commercially available softener emulsions may be used in the present invention. Illustrative examples of commercially available emulsions that can be used herein include FLUFTONE® POLYETHYLENE Softeners from Apollo Chemical Company of Burlington, N.C., and FABRITONE® Fabric Softeners from Noveon, Inc. of Cleveland, Ohio.

Typically, a treatment composition of the invention will contain from about 1 to about 15 weight percent, typically from about 5 to about 8 weight percent, of softener.

The stabilizing surfactant is an anionic surfactant or blend of such surfactants. Preferably the surfactant does not contain significant oxidizable functionality.

It has been unexpectedly discovered that certain anionic surfactants protect the softener emulsion in the bleach composition such that it will impart useful benefits to fabrics treated with the bleach composition while also inhibiting or preventing consumption of the hypochlorite components during storage such that the composition retains more effective bleaching capability when it is used.

Illustrative examples of anion surfactants useful herein include those of the formula:

$$R^3\,(C_6H_{10})(SO_3M^1)O(C_6H_9)(SO_3M^2)$$

wherein $R^3$ is a straight or branched chain alkyl comprising from 6 to 18 carbon atoms and $M^1$ and $M^2$ are the same or different and each is an alkali metal such as sodium, potassium or lithium. One illustrative example of such anionic surfactants is DOWFAX™ 2A1 from Dow Chemical Company.

Typically the softener emulsion will contain from about 5 to about 50 weight percent of such surfactant compositions when blended into bleach compositions of the invention.

Bleaching compositions of the invention can be prepared as follows.

Providing an aqueous emulsion of suitable softener containing a stabilizing surfactant as described above.

The pH range of the aqueous alkali metal hypochlorite solutions of the invention is typically from about 11.0 up to about 14.0. The requisite pH range is achieved by adding an aqueous solution of alkali metal hydroxide (e.g., from 1 molar up to 12.5 molar) to the alkali metal hypochlorite solution which has had or will have added to it the softener emulsion containing a stabilizing surfactant.

Following mixing, the bleach composition is then stored. An advantage of the present invention is that the composition can be stored under room temperature conditions for several weeks or more while retaining good bleaching effectiveness and improved fabric protection as described above.

The hypochlorite bleach composition may, if desired, also contain additional components such as buffers, primary cleansing agents (surfactants), detergents, builders, fluorescent whitening agents, stainblockers, fragrances, pigments, dyes, thickening agents, and defoamers. Buffers preferably comprise one or more of a pH adjusting agent effective to adjust or to maintain the pH of a solution (e.g., wash liquor) in which the hypochlorite bleach composition is added to a pH greater than about 10. Suitable pH adjusting agents, are well known to the art and include, for example, carbonates, borates, phosphates, silicates, and bicarbonates.

In some embodiments, bleach compositions of the invention will be substantially free of whitening agents.

Fragrances are usually blends of volatile oils that are composed of organic compounds such as esters, aldehydes, ketones or mixtures thereof. Such fragrances are usually proprietary materials commercially available from such manufacturers as Quest, International Flavors and Fragrances, Givaudan and Firmenich, Inc. Examples of fragrances which may be suitable for use in the present invention may be found in Laufer et al., U.S. Pat. No. 3,876,551, and Boden et al, U.S. Pat. No. 4,390,448, which are incorporated herein. Stable fragranced hypochlorite bleaching compositions are described, for example, in U.S. Pat. No. 5,080,826.

Compositions of the invention may be readily used. In a typical embodiment, an effective amount of the bleach composition will be contacted to an article, e.g., a fabric article, which is desired to be treated. For example, a desired quantity of the liquid bleach composition may be added to vessel such as a wash tub or basin in which water is already present and then subject articles to be treated are present.

Compositions of the invention will typically be applied to fabric articles, e.g., garments, bolts of fabric, etc. Typically the fabric articles will comprise natural fibers such as wool and cotton. It will be understood, however, that compositions of the invention may be used on other articles, e.g., non-fabric articles, or fabric articles made of other fibers, if desired.

EXAMPLES

The invention will now be explained with the following non-limiting examples.

Surfactant Stability in Bleach

The following procedure was used to determine the stability of various surfactants in bleach.

To 5 grams of surfactant was added 10% sodium hydroxide solution to adjust the pH to approximately 13. To this was slowly added 94 to 95 g of liquid bleach (Target™ Bleach) and the mixture was allowed to stir for 10 minutes. Stability was tested by visual appearance of the solution at room temperature and after accelerated aging at 50° C. The stability data is summarized in Table 1.

TABLE 1

| | | Stability | |
|---|---|---|---|
| Surfactant* | Class of Surfactant | Room Temperature | 50° C. for 2 days |
| DS-10 | Sulfates & Sulfonates | Milky-2 Layers | Two Layers |
| TRITON ™ QS-15 | Sulfates & Sulfonates | Thick Solution | Two Layers |
| TRITON ™ W-30 | Sulfates & Sulfonates | Cloudy | Milky |
| TRITON ™ XN-45S | Sulfates & Sulfonates | Cloudy | Milky |
| TRITON ™ X-200K | Sulfates & Sulfonates | Cloudy, some precipitate | Precipitate |
| DOWFAX ™ 8390 | Alkyl Diphenyl Oxide Disulfonate salts | Clear Yellow Solution | Clear Yellow Solution |
| DOWFAX ™ D 30599 | Alkyl Diphenyl Oxide Disulfonate salts | Clear Yellow Solution | Clear Yellow Solution, slight precipitate |
| DOWFAX ™ 2A1 | Alkyl Diphenyl Oxide Disulfonate salts | Clear Yellow Solution | Clear Yellow Solution |

TABLE 1-continued

| Surfactant* | Class of Surfactant | Stability: Room Temperature | Stability: 50° C. for 2 days |
|---|---|---|---|
| DOWFAX ™ 3B2 | Alkyl Diphenyl Oxide Disulfonate salts | Clear Yellow Solution | Clear Yellow Solution |

*Surfactants:
DS-10 = Dodecylbenzene sulfonate (SIPONATE ™ from Rhone Poulenc of Cranbury, New Jersey)
TRITON ™ QS-15 = Polyether sulfate (from Dow Chemical Company, Midland, MI)
TRITON ™ W-30 = Alkoxylate sulfate (from Dow Chemical Company, Midland, MI)
TRITON ™ XN-45S = Sulfate (from Dow Chemical Company, Midland, MI)
TRITON ™ X-200K = Polyether sulfonate (from Dow Chemical Company, Midland, MI)
DOWFAX ™ 8390, DOWFAX ™ 30599, DOWFAX ™ 2A1, DOWFAX ™ 3B2 = Alkydiphenyloxide Disulfonate salts (from Dow Chemical Company, Midland, MI)

The above data suggests that the alkyldiphenyloxide disulfonate salts are more stable in bleach.

General Procedure for Fabric Washing and Drying

A full size top load washing machine (Sears™ KENMORE™ Elite) was used with the following settings: Normal Wash cycle, Hot/Cold temperature and #10 setting, one rinse, using highest fill.

The washing machine was filled with water. The temperature of the hot water averaged approximately 103° F. (40° C.). Approximately 75 grams of regular Tide™ Liquid laundry detergent (available from Procter & Gamble) was then added to the water. This was followed by adding approximately 250 grams of Target™ brand liquid bleach (with or without the additive) into the water, all around the circular tub. The weight of materials washed was approximately 4 pounds dry weight (approximately 10 men's extra-large t-shirts and 10 washcloths). When the water level reached approximately ¼–⅓ full, the fabrics were placed in the washing machine with an even distribution. At end of each wash cycle, the fabrics were placed into a clothes dryer (Sears™ KENMORE™ Elite) timed for 45 minutes using the highest heat setting (cotton towels/high).

Example 1

1.25 grams of SIPONATE™ DS-10 anionic surfactant was added to 15 grams of a polyethylene wax emulsion (ME29730, available from Michelman, Inc., Cincinnati, Ohio) and the mixture was allowed to stir for 10 minutes. When it was observed that the solution was homogenous, the pH was raised to about 12 to about 13 by using a 10% aqueous sodium hydroxide solution (approximately 44 drops). Then approximately 223 grams of TARGET™ brand liquid bleach was slowly added to the polyethylene was/surfactant solution and the bleach mixture was allowed to stir for 10 minutes.

Fabric appearance was then evaluated after 20 wash/dry laundering cycles (described above) using regular TIDE™ Liquid laundry detergent (75 grams). For comparison fabrics were also evaluated using regular Tide™ Liquid laundry detergent (75 grams) and TARGET™ brand liquid bleach with no additive (250 grams). Five 100% cotton white knit HANES™ t-shirt size extra-large, five FRUIT OF THE LOOM™ 100% cotton white knit size large t-shirts and ten 100% cotton white washcloths with no decoration (WAL-MART brand) were used for a total of approximately four pounds (dry weight). The fabrics were evaluated visually for texture, softness/coarseness, pilling, wear (holes, tears) and whiteness/brightness vs. dinginess/yellowing. The performance data is summarized in Table 2.

TABLE 2

| Formula | Feel | Appearance: Wash Cloths | Appearance: T-Shirts | # of Holes-T-Shirts |
|---|---|---|---|---|
| Example 4 | Softer | Less wear Fibers are denser Reduced yellowing and less dingier than bleach with no additive | Less wear than bleach with no additive Reduced yellowing and less dingier than bleach with no additive | 4 |
| TARGET ™ Liquid Bleach and TIDE ™ Liquid Laundry Detergent (no additive) | Coarse | Fibers are quite worn, stretched and threadbare | Much wear and threadbare Dingier | 61 |

Examples 2–9

The following procedure was typical of that used to make the remaining examples summarized in Table 3 of bleach solutions having the polyethylene wax emulsion/surfactant additive. The indicated amount of stabilizing surfactant was added to 6 grams of a polyethylene wax emulsion (ME29730, available from (Michelman Inc., Cincinnati, Ohio) and the mixture was allowed to stir for 10 minutes. When it was observed that the solution was homogenous, the pH was raised to approximately 12 to 13 by using a 10% aqueous sodium hydroxide solution. Then approximately 92 to 93 grams of TARGET™ liquid bleach was slowly added to the polyethylene wax/surfactant solution and the bleach mixture was allowed to stir for 10 minutes.

The initial appearance of the bleach composition after mixing was noted. The compositions were then stored at 40° C. and visually examined periodically. The time at which the homogenous composition was observed to have become heterogenous (i.e., no longer clear, separated into separate phases, etc.) is noted in the far right column.

TABLE 3

| Example | Wax Emulsion* | Wax Emulsion Particle Size (microns) | Surfactant | Appearance in Bleach | Time |
|---|---|---|---|---|---|
| Control | ME29730 | 0.045 | NONE | Slightly hazy | <1 day |
| 2 | ME29730 | 0.045 | DS-10 (1 g) | Slightly hazy | 4 days |
| 3 | ME29730 | 0.045 | TRITON ™ W-30 (1 g) | Milky solution | 2 days |
| 4 | ME29730 | 0.045 | DOWFAX ™ 2A1 (1 gram) | Slightly hazy | 10 days |
| 5 | ME29730 | 0.045 | DOWFAX ™ 2A1 (0.5 grams) | Slightly hazy | 10 days |
| 6 | ME29730 | 0.045 | DOWFAX ™ 3B2 (1 gram) | Slightly hazy | 10 days |

TABLE 3-continued

| Example | Wax Emulsion* | Wax Emulsion Particle Size (microns) | Surfactant | Appearance in Bleach | Time |
|---|---|---|---|---|---|
| 7 | ME29730 | 0.045 | DOWFAX ™ 3B2 (0.5 grams) | Slightly hazy | 10 days |
| 8 | ME32535 | 0.035 | DOWFAX ™ 2A1 (1 g) | Slightly hazy | 10 days |
| 9 | ME72040 | 0.175 | DOWFAX ™ 2A1 (1 g) | Milky solution | 3 days |
| 10 | ME43040 | 0.045 | DOWFAX ™ 2A1 (1 g) | Slightly hazy | 5 days |

*ME29730, ME32535, and ME72040 are all polyethylene wax emulsions and are available from Michelman, Inc., Cincinnati, Ohio.

The data in Table 3 suggests that when additional surfactants are added to a solution of the polyethylene wax additive and bleach, the stability of the additive in bleach improves. The anionic surfactants of the sulfates and sulfonates type improve the stability of the polyethylene wax additive in bleach compared to the control (no post added surfactant). Alkydiphenyloxide disulfonate salts type surfactants when post added to the wax emulsion seem to show further enhancement in keeping the additive stable after it is mixed with a bleach solution.

Various modifications and alterations to this invention will become apparent to those skilled in the art without departing from the scope and spirit of this invention. It should be understood that this invention is not intended to be unduly limited by the illustrative embodiments and examples set forth herein and that such examples and embodiments are presented by way of example only with the scope of the invention intended to be limited only by the claims set forth herein as follows.

What is claimed is:

1. A liquid composition useful for bleaching fabrics comprising an aqueous mixture of a softener emulsion and alkali metal hypochlorite wherein said softener emulsion contains a stabilizing surfactant wherein said stabilizing surfactant is an anionic surfactant having the formula:

$$R^3\,(C_6H_{10})(SO_3M^1)O(C_6H_9)(SO_3M^2)$$

wherein $R^3$ is a straight or branched chain alkyl comprising from 6 to 18 carbon atoms and $M^1$ and $M^2$ are the same or different and each is an alkali metal such as sodium, potassium or lithium, wherein said softener is selected from the group consisting of polyethylene-based softeners and polypropylene-based softeners, and wherein said composition is substantially free of whitening agent.

2. The composition of claim 1 wherein said alkali metal hypochlorite is selected from the group consisting of sodium hypochlorite, potassium hypochlorite, lithium hypochlorite, and mixtures thereof.

3. The composition of claim 1 wherein pH of said composition is from about 10.0 to about 14.0

4. The composition of claim 1 wherein said softener is selected from the group consisting of oxidized polyethylene, polyethylene acrylic acid, polyethylene/polypropylene copolymers, polypropylene, polyethylene, polyethylene/paraffin wax emulsions, and combinations thereof.

5. The composition of claim 1 further comprising one or more additives selected from the group consisting of buffers, primary cleansing agents (surfactants), detergents, builders, stainblockers, fragrances, pigments, dyes, thickening agents, and defoamers.

6. A method of treating a substrate comprising contacting said substrate with an effective amount of a composition of claim 1.

7. The method of claim 6 wherein said substrate comprises fabric.

8. The method of claim 7 wherein said substrate comprises natural fiber.

9. A method of preparing a liquid composition substantially free of whitening agents and useful for bleaching fabric articles comprising providing an aqueous softener emulsion containing an anionic stabilizing surfactant having the formula:

$$R^3\,(C_6H_{10})(SO_3M^1)O(C_6H_9)(SO_3M^2)$$

wherein $R^3$ is a straight or branched chain alkyl comprising from 6 to 18 carbon atoms and $M^1$ and $M^2$ are the same or different and each is an alkali metal such as sodium, potassium or lithium, and mixing said emulsion with an aqueous solution of alkali metal hypochlorite wherein said softener is selected from the group consisting of polyethylene-based softeners and polypropylene-based softeners.

10. The method of claim 9 wherein said softener is selected from the group consisting of oxidized polyethylene, polyethylene acrylic acid, polyethylene/polypropylene copolymers, polypropylene, polyethylene, polyethylene/paraffin wax emulsions, and combinations thereof.

11. A method of making a composition of claim 1 comprising (a) providing an aqueous emulsion of softener containing an anionic stabilizing surfactant having the formula:

$$R^3\,(C_6H_{10})(SO_3M^1)O(C_6H_9)(SO_3M^2)$$

wherein $R^3$ is a straight or branched chain alkyl comprising from 6 to 18 carbon atoms and $M^1$ and $M^2$ are the same or different and each is an alkali metal such as sodium, potassium or lithium and wherein said softener is selected from the group consisting of polyethylene-based softeners and polypropylene-based softeners, (b) providing an aqueous alkali metal hypochlorite bleach solution, and (c) mixing said aqueous emulsion and said aqueous solution.

12. The method of claim 11 further comprising emulsifying a softener in the present of a surfactant and water to yield a preliminary emulsion and then adding an anionic stabilizing surfactant to said preliminary emulsion to yield said aqueous emulsion.

* * * * *

UNITED STATES PATENT AND TRADEMARK OFFICE

CERTIFICATE OF CORRECTION

PATENT NO. : 7,214,652 B1
APPLICATION NO. : 11/323794
DATED : May 8, 2007
INVENTOR(S) : Chetan P. Jariwala It is certified that error appears in the above-identified patent and that said Letters Patent is hereby corrected as shown below:

Title Page item (56) under Other Publications, Column 2
Line 1, delete "publicaiton" and insert -- publications --, therefor.

Column 1
Line 16, delete "However," and insert -- However --, therefor.
Line 26, delete "(Borden et al.)" and insert -- (Boden et al.) --, therefor.
Line 27, delete "amide" and insert -- amine --, therefor.

Column 5
Line 19, delete "Alkydiphenyloxide" and insert -- Alkyldiphenyloxide --, therefor.

Column 7
Line 25, delete "Alkydiphenyloxide" and insert -- Alkyldiphenyloxide --, therefor.

Column 8
Line 1, claim 3, before "pH" insert -- the --.

Signed and Sealed this

Twenty Second Day of April, 2008

JON W. DUDAS
*Director of the United States Patent and Trademark Office*